US009890757B2

(12) United States Patent
Mizukami et al.

(10) Patent No.: US 9,890,757 B2
(45) Date of Patent: Feb. 13, 2018

(54) ELECTRONIC CONTROL OF A SPARK PLUG FOR AN INTERNAL COMBUSTION ENGINE

(75) Inventors: Hiroshi Mizukami, Chiyoda-ku (JP); Hisanori Nobe, Chiyoda-ku (JP); Toru Ikeda, Chiyoda-ku (JP); Yoshiyuki Sera, Chiyoda-ku (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 830 days.

(21) Appl. No.: 13/044,059

(22) Filed: Mar. 9, 2011

(65) Prior Publication Data

US 2012/0085327 A1 Apr. 12, 2012

(30) Foreign Application Priority Data

Oct. 12, 2010 (JP) ..... 2010-229556

(51) Int. Cl.

| | |
|---|---|
| ***F02P 3/02*** | (2006.01) |
| ***F02P 3/04*** | (2006.01) |
| ***F02P 11/00*** | (2006.01) |
| *F02P 9/00* | (2006.01) |

(52) U.S. Cl.

CPC ..... *F02P 3/0442* (2013.01); *F02P 11/00* (2013.01); *F02P 9/002* (2013.01)

(58) Field of Classification Search

CPC ... F01L 2800/12; F01L 9/04; F02D 2041/001; F02D 2041/2051; F02D 2041/2058; F02P 3/055

USPC ..... 123/626, 605, 618, 625, 630; 324/382

See application file for complete search history.

(56) References Cited

U.S. PATENT DOCUMENTS

| | | | | |
|---|---|---|---|---|
| 5,819,713 | A * | 10/1998 | Kesler | 123/630 |
| 6,575,134 | B1 * | 6/2003 | Bowling | 123/335 |
| 6,807,042 | B2 * | 10/2004 | Spampinato et al. | 361/103 |
| 6,955,164 | B2 * | 10/2005 | Kesler et al. | 123/630 |
| 2011/0141651 | A1 * | 6/2011 | Godo et al. | 361/263 |

FOREIGN PATENT DOCUMENTS

JP 2008-045514 A 2/2008

* cited by examiner

*Primary Examiner* — Hai Huynh
*Assistant Examiner* — Gonzalo Laguarda
(74) *Attorney, Agent, or Firm* — Sughrue Mion, PLLC; Richard C. Turner

(57) ABSTRACT

An internal-combustion-engine electronic control system according to the present invention is provided with a power switching device that applies or shuts off a primary current of an ignition coil of an internal combustion engine so that at the secondary side of the ignition coil, there is generated a voltage for making an ignition plug of the internal combustion engine produce a spark discharge; and a control unit that turns on or off the power switching device. The internal-combustion-engine electronic control system is characterized in that the control unit is provided with a circuit unit that makes the power switching device softly shut off so as to prevent the ignition plug from producing the spark discharge, and in accordance with the characteristics of the power switching device, the control unit changes the characteristics of the soft shutoff halfway through the shutoff operation.

12 Claims, 6 Drawing Sheets

ELECTRONIC CONTROL OF A SPARK PLUG FOR AN INTERNAL COMBUSTION ENGINE

BACKGROUND OF THE INVENTION

Field of the Invention

The present invention relates to an internal-combustion-engine electronic control system and particularly to an electronic control system that controls an internal-combustion-engine ignition device.

Description of the Related Art

As is well known, in an internal-combustion-engine ignition device, for example, in the case where an ignition signal is inputted for a time longer than a predetermined time, in the case where an electronic component included in the ignition device overheats, or in the case where an excessive current flowing in an ignition coil is detected, it is required to forcibly shut off the primary current of the ignition coil at a timing different from the regular ignition timing so as to protect the ignition device.

However, in the case where the primary current of an ignition coil is forcibly shut off at a timing different from the regular ignition timing, it is required to softly shut off the primary current of an ignition coil in order to prevent a high voltage, which is high enough to cause a spark discharge in the ignition plug, from being generated across the secondary winding of the ignition coil; additionally, in order to suppress heat generation in an electronic component as much as possible, the soft shutoff operation needs to be implemented in a minimum time.

To date, there has been disclosed an internal-combustion-engine ignition device where there are included a current limiting circuit that limits a primary current flowing in an ignition coil, a timer circuit that serves as an abnormality detection means, and a detection circuit that detects abnormal heating, and when any one of these circuits detects an abnormality, the primary current of the ignition coil is softly shut off in a time between 17 [ms] and 135 [ms] (for example, refer to Patent Document 1).

Patent Document 1: JP-A-2008-45514

The conventional system disclosed in Patent Document 1 is provided with a circuit that softly shuts off the primary current of an ignition coil in a time between 17 [ms] and 135 [ms] when an abnormality in an ignition device is detected; however, neither the inductance and the impedance of an ignition coil nor the characteristics of an insulated-gate bipolar transistor is taken into account. As a result, there has been a problem that the time of soft shutoff varies depending on these values, the characteristics, the limiting value for the primary current of an ignition coil, or the like.

SUMMARY OF THE INVENTION

The present invention has been implemented in order to solve the problem in the foregoing conventional system; the objective thereof is to provide an internal-combustion-engine electronic control system capable of softly shutting off the primary current of an ignition coil in an optimum time.

An internal-combustion-engine electronic control system according to the present invention is provided with a power switching device that applies or shuts off a primary current of an ignition coil of an internal combustion engine so that at the secondary side of the ignition coil, there is generated a voltage for making an ignition plug of the internal combustion engine produce a spark discharge; and a control unit that turns on or off the power switching device. The internal-combustion-engine electronic control system is characterized in that the control unit is provided with a circuit unit that makes the power switching device softly shut off so as to prevent the ignition plug from producing the spark discharge, in the case where at least one of the power switching device, the control unit, the ignition coil, and the ignition plug is in a predetermined state; and based on a change in the conduction state of the power switching device, the characteristics of the soft shutoff is changed halfway through the shutoff operation.

In the present invention, the description that "at least one of the power switching device, the control unit, the ignition coil, and the ignition plug is in a predetermined state" means a state where the continuous conduction duration of the power switching device exceeds a predetermined time, a state where the value of the primary current of the ignition coil exceeds a predetermined value, a state where the temperature of at least part of constituent elements included in the control unit, the ignition coil, the ignition plug, the power switching device, or the like exceeds a predetermined value, or a state similar to each of the foregoing states.

An internal-combustion-engine electronic control system according to the present invention is provided with a power switching device that applies or shuts off a primary current of an ignition coil of an internal combustion engine so that at the secondary side of the ignition coil, there is generated a voltage for making an ignition plug of the internal combustion engine produce a spark discharge; and a control unit that turns on or off the power switching device. The internal-combustion-engine electronic control system is characterized in that the control unit is provided with a circuit unit that makes the power switching device softly shut off so as to prevent the ignition plug from producing the spark discharge, in the case where at least one of the power switching device, the control unit, the ignition coil, and the ignition plug is in a predetermined state; in that the circuit unit includes a capacitor, a first slow-discharge circuit that makes electric charge in the capacitor discharge with a predetermined time constant, and a second slow-discharge circuit that makes electric charge in the capacitor discharge with a time constant that is smaller than the time constant of the first slow-discharge circuit 15; and in that based on the predetermined state, the control unit selects one of the first slow-discharge circuit and the second slow-discharge circuit and makes the capacitor discharge electric charge so as to perform the soft shutoff.

In the present invention, the description that "at least one of the power switching device, the control unit, the ignition coil, and the ignition plug is in a predetermined state" means a state where the continuous conduction duration of the power switching device exceeds a predetermined time, a state where the value of the primary current of the ignition coil exceeds a predetermined value, a state where the temperature of at least part of constituent elements included in the control unit, the ignition coil, the ignition plug, the power switching device, or the like exceeds a predetermined value, or a state similar to each of the foregoing states.

In the internal-combustion-engine electronic control system according to the present invention, the control unit, which turns on or off the power switching device, is provided with a circuit unit that makes the power switching device softly shut off so as to prevent the ignition plug from producing the spark discharge, in the case where at least one of the power switching device, the control unit, the ignition coil, and the ignition plug is in a predetermined state; and based on a change in the conduction state of the power switching device, the characteristics of the soft shutoff is changed halfway through the shutoff operation. Therefore, in the case where the primary current of the ignition coil is forcibly shut off at a timing different from the regular ignition timing, the soft shutoff operation can be performed at an optimum timing, regardless of the characteristics of the ignition coil itself or the characteristics of the power switching device.

Moreover, the internal-combustion-engine electronic control system according to the present invention is configured in such a way that the control unit, which turns on or off the power switching device, is provided with a circuit unit that makes the power switching device softly shut off so as to prevent the ignition plug from producing the spark discharge, in the case where at least one of the power switching device, the control unit, the ignition coil, and the ignition plug is in a predetermined state; in such a way that the circuit unit includes a capacitor, a first slow-discharge circuit that makes electric charge in the capacitor discharge with a predetermined time constant, and a second slow-discharge circuit that makes electric charge in the capacitor discharge with a time constant that is smaller than the time constant of the first slow-discharge circuit 15; and in such a way that based on the predetermined state, the control unit selects one of the first slow-discharge circuit and the second slow-discharge circuit and makes the capacitor discharge electric charge so as to perform the soft shutoff. Therefore, in the case where the primary current of the ignition coil is forcibly shut off at a timing different from the regular ignition timing, the soft shutoff operation can be performed at an optimum timing, regardless of the characteristics of the ignition coil itself or the characteristics of the power switching device.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
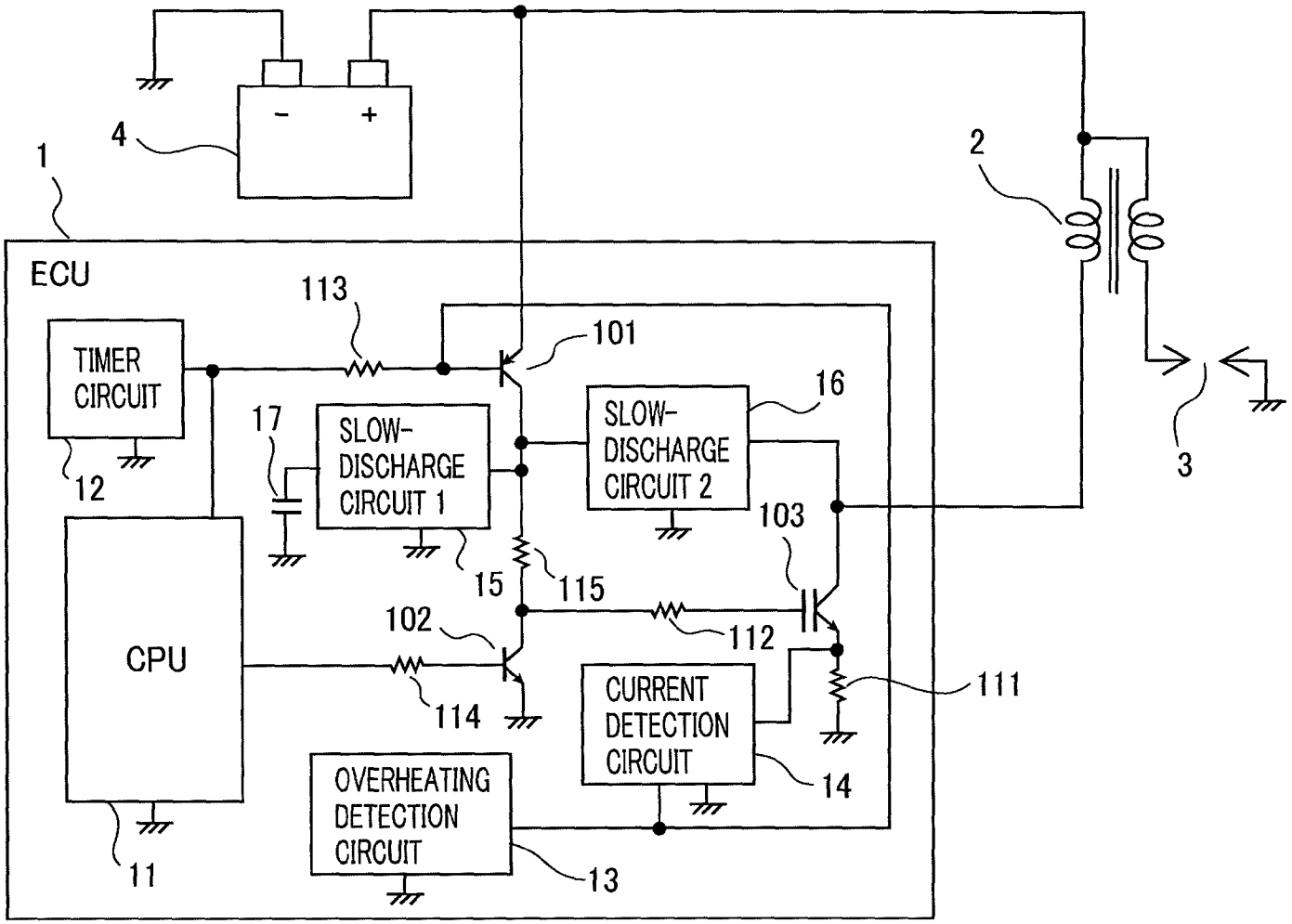
FIG. 1 is a block diagram of an internal-combustion-engine electronic control system according to Embodiment 1 of the present invention.

FIG. 1 is a block diagram of an internal-combustion-engine electronic control system according to Embodiment 1 of the present invention. In FIG. 1, an internal-combustion-engine electronic control system (referred to as an ECU, hereinafter) 1 controls a current that flows in the primary winding of an ignition coil 2. An ignition plug 3 produces a spark discharge by use of a high voltage induced across the secondary winding of the ignition coil 2 so as to ignite a fuel in an unillustrated combustion chamber of an internal combustion engine. A battery 4 supplies electric power to ECU 1 and the ignition coil 2.

Next, the configuration of ECU 1 will be explained. In ECU 1, the output terminal of a calculation device (referred to as CPU, hereinafter) 11 is connected with the base of an NPN-type transistor 102 by way of a resistor 114. The collector of the transistor 102 is connected with the base or the gate of a power switching device 103 by way of a resistor 112.

The collector of the NPN-type transistor 102 is connected with the collector of a PNP-type transistor 101 by way of a resistor 115. The emitter of the PNP-type transistor 101 is connected with the positive electrode of the battery 4. A timer circuit 12 is connected with CPU 11 and a resistor 113 connected with the base of the PNP-type transistor 101. The emitter of the power switching device 103 is grounded by way of a resistor 111; the collector thereof is connected with the primary winding of the ignition coil 2.

A first slow-discharge circuit 15 is connected between a capacitor 17 and the connection point between the collector of the PNP-type transistor 101 and the resistor 115; a second slow-discharge circuit 16 is connected between the collector of the PNP-type transistor 101 and the collector of the power switching device 103.

In ECU 1, the constituent components excluding the power switching device 103 configure a control device for turning on or off the power switching device 103.

The first slow-discharge circuit 15 and the second slow-discharge circuit 16 configure a circuit unit that softly shuts off the power switching device 103 in order to prevent the ignition plug 3 from producing a spark discharge in the case where at least one of the power switching device 103 and the foregoing control device is in a predetermined state, described later.

A current detection circuit 14 is connected between the connection point between the emitter of the power switching device 103 and the resistor 111 and the connection point between the base of the PNP-type transistor 101 and the resistor 113. An overheating detection circuit 13 is connected with the base of the PNP-type transistor 101 and the current detection circuit 14.

An ignition signal outputted from CPU 11 is inputted to the base of the NPN-type transistor 102 by way of the resistor 114 and then is transferred to the base of the power switching device 103 by way of the resistor 112. The ignition signal transferred to the base of the power switching device 103 becomes HIGH level or LOW level so as to turn on or off the power switching device 103, so that energization/de-energization control of the primary winding of the ignition coil 2 is performed.

The timer circuit 12 counts the energization duration in which the ignition signal outputted from CPU 11 is HIGH level; in the case where the energization duration is shorter than a predetermined time, the timer circuit 12 outputs a LOW-level signal and inputs it to the base of the PNP-type transistor 101 by way of the resistor 113; in the case where the energization duration is longer than the predetermined time, the timer circuit 12 outputs a HIGH-level signal and inputs it to the base of the PNP-type transistor 101 by way of the resistor 113. The CPU 11 outputs an energization permission signal or an energization prohibition signal for the ignition coil 2 and inputs it to the base of the PNP-type transistor 101 by way of the resistor 113.

When detecting abnormal heating in the overheating detection circuit 13, the power switching device 103 changes the level of its output signal from LOW to HIGH, and then inputs the HIGH-level signal to the base of the PNP-type transistor 101. When determining, based on the voltage across the resistor 111, that an excessive current is flowing in the power switching device 103, the current detection circuit 14 changes the level of its output signal from LOW to HIGH, and then inputs the HIGH-level signal to the base of the PNP-type transistor 101.

Figure 2:
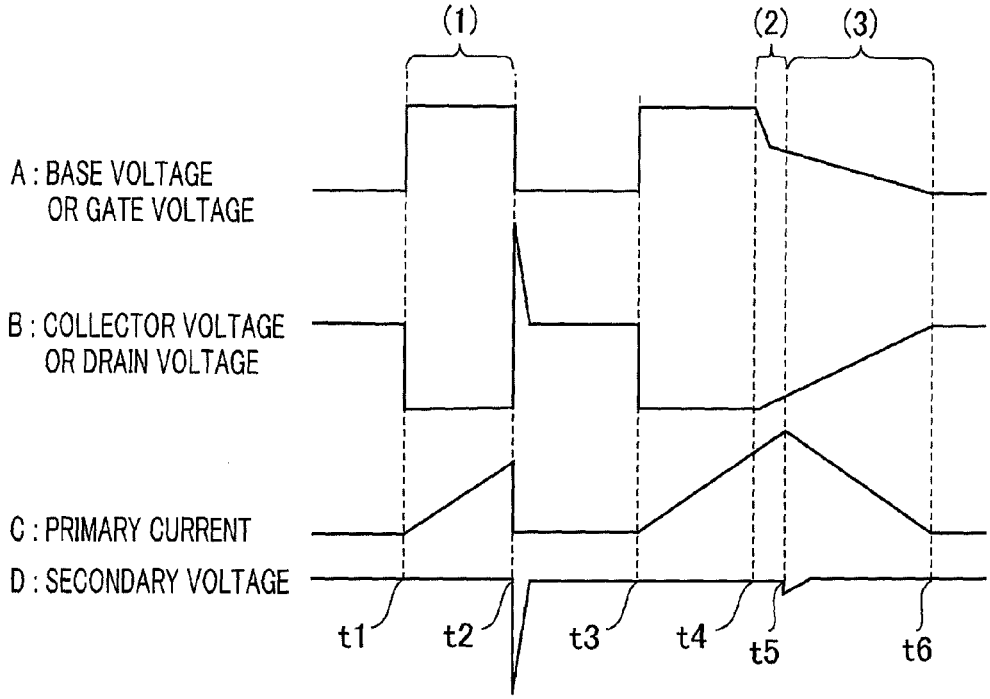
FIG. 2 is a timing chart for explaining the operation of an internal-combustion-engine electronic control system according to Embodiment 1 of the present invention.

ECU 1 is configured in such a way as described above; therefore, in the case where any one of CPU 11, the timer circuit 12, the overheating detection circuit 13, and the current detection circuit 14 outputs a HIGH-level signal, the PNP-type transistor 101 turns off, so that the primary current of the ignition coil is softly shut off, as described later. In this situation, the case where any one of the timer circuit 12, the overheating detection circuit 13, and the current detection circuit 14 outputs a HIGH-level signal corresponds to the foregoing case where at least one of the power switching device 103 and the control device is in a predetermined state Next, there will be explained the operation of the internal-combustion-engine electronic control system, according to Embodiment 1 of the present invention, that is configured as described above. FIG. 2 is a timing chart for explaining the operation of the internal-combustion-engine electronic control system according to Embodiment 1 of the present invention. FIG. 2(A) represents the waveform of the base voltage or the gate voltage of the power switching device 103; FIG. 2(B) represents the waveform of the collector voltage or the drain voltage of the power switching device 103; FIG. 2(C) represents the waveform of the primary current flowing in the primary winding of the ignition coil 2; FIG. 2(D) represents the waveform of the secondary voltage induced across the secondary winding of the ignition coil 2.

In FIG. 2, in the duration (1) from a time point t1 to a time point t2, based on the ignition signal outputted from CPU 11, a base voltage A or a gate voltage A of a predetermined HIGH level is applied to the base or the gate of the power switching device 103. As a result, the power switching device 103 turns on; the collector voltage B or the drain voltage B thereof becomes an electric potential of a predetermined LOW level, whereby the primary current flowing in the primary winding of the ignition coil 2 gradually increases. In this situation, no voltage is induced across the ignition coil 2.

At the time point t2 when the duration (1) terminates, the base voltage A or the gate voltage A of the power switching device 103 is shut out, thereby changing to the LOW level. As a result, the power switching device 103 turns off; the collector voltage B or the drain voltage B thereof instantaneously changes from the LOW level to a high voltage because the primary current C of the ignition coil 2 is shut off, and then becomes a predetermined HIGH level. Because the primary current C of the ignition coil 2 is shut off at the time point t2, a secondary voltage D, which is a negative high voltage, is induced across the secondary winding of the ignition coil 2. An ignition plug 3 produces a spark discharge by use of the secondary voltage, which is a negative high voltage induced across the secondary winding of the ignition coil 2, so as to ignite a fuel in an unillustrated combustion chamber of the internal combustion engine.

Next, at a time point t3, based on the ignition signal outputted from CPU 11, the base voltage A or the gate voltage A of the predetermined HIGH level is applied again to the base or the gate of the power switching device 103. As a result, the power switching device 103 turns on; the collector voltage B or the drain voltage B thereof becomes an electric potential of a predetermined LOW level, whereby the primary current flowing in the primary winding of the ignition coil 2 gradually increases. In this situation, no voltage is induced across the ignition coil 2.

In this case, for example, when at a time point t4, the duration where the ignition signal from CPU 11 is HIGH-level exceeds a predetermined time, the level of the output signal of the timer circuit 12 changes from the LOW level to the HIGH level, whereby the state of the PNP-type transistor 101 changes from "ON" to "OFF". Alternatively, when at the time point t4, the overheating detection circuit 13 detects the fact that an electronic component included in the ignition device has overheated, a signal of HIGH level from the overheating detection circuit 13 is applied to the base of the PNP-type transistor 101; therefore, the state of the PNP-type transistor 101 changes from "ON" to "OFF". Alternatively, when at the time point t4, the current detection circuit 14 detects the fact that a current flowing in the power switching device 103 is the same as or larger than a predetermined value, a signal of HIGH level from the current detection circuit 14 is applied to the base of the PNP-type transistor 101; therefore, the state of the PNP-type transistor 101 changes from "ON" to "OFF".

When the PNP-type transistor 101 turns off at the time point t4, the electric charge stored in the capacitor 17 is slowly discharged by way of the first slow-discharge circuit 15 and the second slow-discharge circuit 16. The discharge time constant of the second slow-discharge circuit 16 is set to be smaller than that of the first slow-discharge circuit 15; thus, the electric charge in the capacitor 17 is discharged with the small time constant through the second slow-discharge circuit 16, and hence the base voltage A or the gate voltage A of the power switching device 103 rapidly lowers as represented in the duration (2) in FIG. 2. As a result, the power switching device 103 moves from the saturation region to the active region, so that the conduction state of the power switching device 103 changes.

During the duration (2) in FIG. 2, the primary current of the ignition coil 2 slightly increases; however, because the duration (2) is only several tens micro-seconds, the primary current does not considerably increase. Even after the power switching device 103 has moved to the active region, the base voltage A or the gate voltage A continues to lower; in contrast, the collector voltage B or the drain voltage B of the power switching device 103 starts to rise.

Next, in the case where at a time point t5, the base voltage A or the gate voltage A of the power switching device 103 and the collector voltage B or the drain voltage B of the power switching device 103 balance with each other, the discharging path for the capacitor 17 through the second slow-discharge circuit 16 is cut off, and hence the discharging operation moves into the mode where discharge is implemented only through the first slow-discharge circuit 15. Because as described above, the time constant of the first slow-discharge circuit 15 is set to be larger than that of the second slow-discharge circuit 16, the base voltage A or the gate voltage A of the power switching device 103 lowers further slowly, as represented in the duration (3) in FIG. 2, so that the power switching device 103 performs soft shutoff operation. When the base voltage A or the gate voltage A of the power switching device 103 and the collector voltage B or the drain voltage B of the power switching device 103 balance with each other, the conduction state of the power switching device 103 changes.

The time of soft shutoff by the power switching device 103 is a time in which the secondary voltage D induced, through the soft shutoff, across the secondary winding of the ignition coil 2 becomes a voltage value with which no spark discharge is produced in the ignition plug. As described above, by shutting off the power switching device 103 at a timing different from the regular ignition timing, the primary current of the ignition coil is forcibly shut off; however, because at this moment, the ignition plug 3 produces no ignition spark, the ignition device can be protected.

Figure 3:
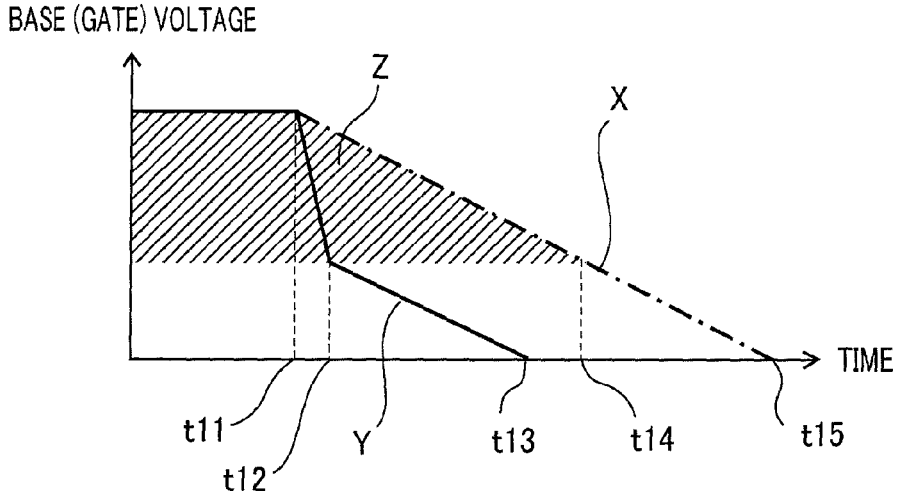
FIG. 3 is an explanatory graph for comparing the operation of a conventional system with the operation of an internal-combustion-engine electronic control system according to Embodiment 1 of the present invention.

FIG. 3 is an explanatory graph for comparing the operation of a conventional system with the operation of the internal-combustion-engine electronic control system according to Embodiment 1 of the present invention; the ordinate denotes the base (gate) voltage of the power switching device 103, and the abscissa denotes time. In FIG. 3, the dashed line X represents the waveform of soft shutoff operation by a conventional system; the solid line Y represents the waveform of soft shutoff operation by the internal-combustion-engine electronic control system according to Embodiment 1 of the present invention. The hatched area Z denotes a region where the power switching device 103 is completely "ON", i.e., in the saturation state; because providing no effect to soft shutoff of the primary current of the ignition coil 2, the slow discharge operation in the area Z only dissipates time.

As represented in FIG. 3, in the case of the soft shutoff operation by the conventional system, the base voltage or the gate voltage of the power switching device 103 starts to slowly lower at a time point t11, as represented by the waveform X; however, until a time point t14 when the base voltage or the gate voltage of the power switching device 103 leaves the area Z, soft shutoff is not started, and during the time between the time point t14 and a time point t15, soft shutoff is performed. Accordingly, in the time between the time point t11 and the time point t14, soft shutoff is not performed, whereby electric power is dissipated wastefully.

In contrast, in the soft shutoff operation by the internal-combustion-engine electronic control system according to Embodiment 1 of the present invention, as represented by the waveform Y, at the time point t11 at first, slow discharge by the second slow-discharge circuit 16, which is relatively rapid, is started, and then at a time point t12, the soft discharge leaves the area Z; after the time point t12, slow discharge by the first slow-discharge circuit 15, which is relatively slow, is performed. As a result, the soft shutoff operation by the power switching device 103 is performed in the time between the time point t12 and the time point t13. Accordingly, in the internal-combustion-engine electronic control system according to Embodiment 1 of the present invention, soft shutoff operation is started earlier than in the conventional system; thus, compared with the conventional system, wasteful dissipation of electric power can be suppressed as much as possible.

In addition, adjustment of the respective time constants of the first slow-discharge circuit 15 and the second slow-discharge circuit 16 makes it possible to adjust the starting time point of soft shutoff or the duration of soft shutoff operation.

Figure 4:
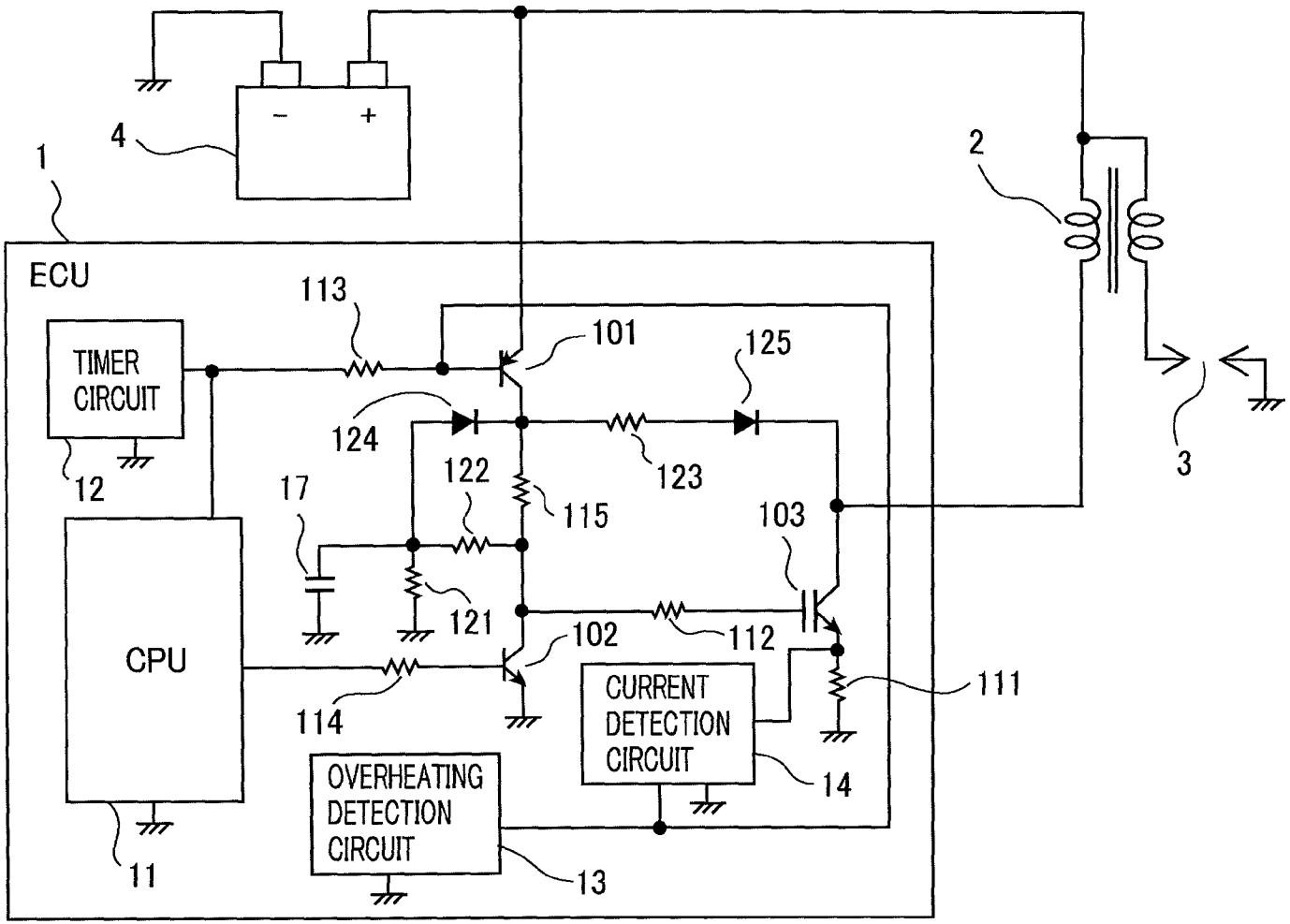
FIG. 4 is a block diagram illustrating a specific circuit for an internal-combustion-engine electronic control system according to Embodiment 1 of the present invention.

FIG. 4 is a block diagram illustrating a specific circuit for the internal-combustion-engine electronic control system according to Embodiment 1 of the present invention. In FIG. 4, the capacitor 17 for slow discharge and a resistor 121 connected with the capacitor 17 configure the first slow-discharge circuit in FIG. 1. A resistor 123, a diode 124, and a diode 125 configure the second slow-discharge circuit 16 in FIG. 1.

That is to say, when at the time point t4 in FIG. 2, the PNP-type transistor 101 turns off, the charge stored in the capacitor 17 is discharged through the diode 124, the resistor 123 and the diode 125 that configure the second slow-discharge circuit 16 having a small time constant, the diode 125, and the power switching device 103. As a result, the base voltage A or the gate voltage A of the power switching device 103 rapidly lowers, as represented in the duration (2) in FIG. 2; the power switching device 103 moves from the saturation region to the active region; thus, the conduction state of the power switching device 103 changes.

Next, in the case where at a time point t5, the base voltage A or the gate voltage A of the power switching device 103 and the collector voltage B or the drain voltage B of the power switching device 103 balance with each other, the discharging path for the capacitor 17 through the diode 124, the resistor 123, and the diode 125 that configure the second slow-discharge circuit 16 is cut off, and hence the discharging operation moves into the mode where discharge is implemented only through the discharging path consisting of the resistor 121 that forms the first slow-discharge circuit 15. Because as described above, the time constant of the first slow-discharge circuit 15 is set to be larger than that of the second slow-discharge circuit 16, the base voltage A or the gate voltage A of the power switching device 103 lowers further slowly, as represented in the duration (3) in FIG. 2, so that the power switching device 103 performs soft shutoff operation.

In the circuitry illustrated in FIG. 4, the resistors 115 and 121, a resistor 122, and the capacitor 17 configure a circuit for suppressing the secondary voltage of the ignition coil 2 from making the ignition plug 3 produce a spark discharge. In other words, when the energization of the ignition coil 2 is started, the capacitor 17 is charged with a charging time constant of a circuit consisting of the resistors 115, 122, and 121. Accordingly, when the power switching device 103 turns on, the base voltage or the gate voltage in the active region is suppressed from rapidly rising and hence a current is prevented from steeply flowing into the primary coil of the ignition coil 2; thus, it is made possible to make an adjustment for preventing the secondary voltage of the ignition coil 2 from making the ignition plug produce a spark discharge.

The internal-combustion-engine electronic control system according to Embodiment 1 of the present invention, described heretofore, is provided with characteristics set forth below:

(1) The internal-combustion-engine electronic control system is provided with a power switching device that applies or shuts off a primary current of an ignition coil of an internal combustion engine so that at the secondary side of the ignition coil, there is generated a voltage for making an ignition plug of the internal combustion engine produce a spark discharge; and a control unit that turns on or off the power switching device. The internal-combustion-engine electronic control system is characterized in that the control unit is provided with a circuit unit that makes the power switching device softly shut off so as to prevent the ignition plug from producing the spark discharge, in the case where at least one of the power switching device, the control unit, the ignition coil, and the ignition plug is in a predetermined state; and in that based on a change in the conduction state of the power switching device, the characteristics of the soft shutoff is changed halfway through the shutoff operation.

(2) The internal-combustion-engine electronic control system is characterized in that the circuit unit includes a capacitor, a first slow-discharge circuit that makes electric charge in the capacitor discharge with a predetermined time constant, and a second slow-discharge circuit that makes electric charge in the capacitor discharge with a time constant that is smaller than the time constant of the first slow-discharge circuit; and in that when the soft shutoff is started, the control unit makes electric charge in the capacitor discharge by use of the second slow-discharge circuit so as to make the power switching device perform soft shutoff operation, and then makes electric charge in the capacitor discharge by use of the first slow-discharge circuit so as to make the power switching device perform soft shutoff operation.

(3) In the control unit, the circuit unit is provided with a function of suppressing a secondary voltage from making the ignition plug produce a spark discharge when energization of the ignition coil with the primary current is started.

(4) The control unit is provided with a current detection circuit that detects the primary current flowing in the ignition coil, and when the current detection circuit detects the fact that the primary current is the same as or larger than a predetermined value, the control unit selects one of the first slow-discharge circuit and the second slow-discharge circuit so as to perform the soft shutoff.

(5) The control unit is provided with an overheating detection circuit that detects overheating in at least one of the constituent elements included in the control unit, and when the overheating detection circuit detects the overheating, the control unit selects one of the first slow-discharge circuit and the second slow-discharge circuit so as to perform the soft shutoff.

(6) The control unit is provided with a timer circuit that detects a continuous energization duration of the primary current flowing in the ignition coil, and when the timer circuit detects the fact that the continuous energization duration is the same as or longer than a predetermined value, the control unit selects one of the first slow-discharge circuit and the second slow-discharge circuit so as to perform the soft shutoff.

Embodiment 2

Next, there will be explained an internal-combustion-engine electronic control system according to Embodiment 2 of the present invention. In an internal-combustion-engine electronic control system according to Embodiment 2 of the present invention is characterized in that by use of a timer circuit that determines, based on a change in the engine rotation speed, whether or not energization is being abnormally implemented, by measuring the energization duration of the primary current of an ignition coil, a current detection circuit that detects the primary current flowing in the ignition coil, and a heat detection circuit that detects abnormal heating, the operation status of the power switching device is recognized, the time constant for capacitor slow discharge operation is selected, and then the power switching device is softly shut off.

Figure 5:
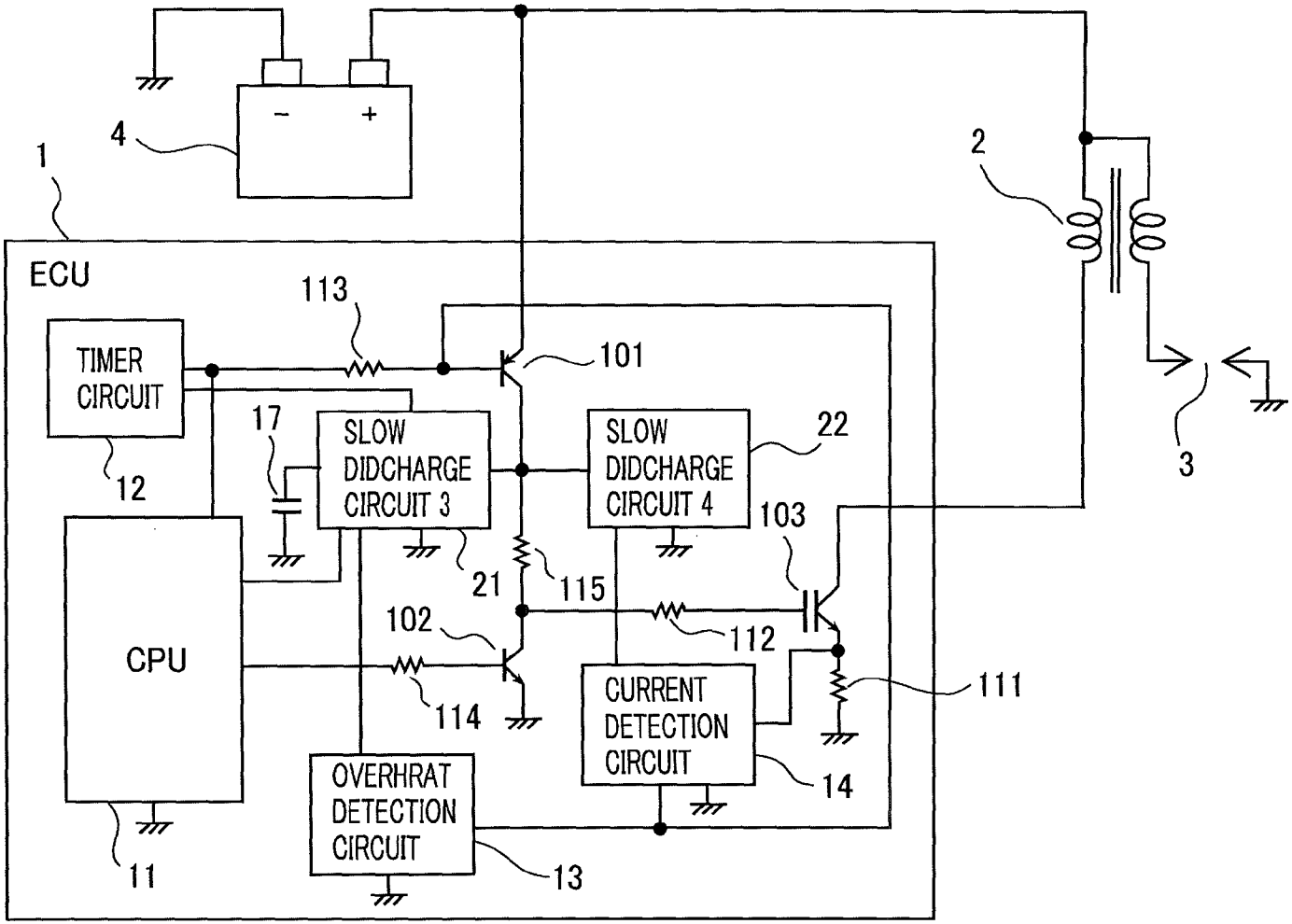
FIG. 5 is a block diagram of an internal-combustion-engine electronic control system according to Embodiment 2 of the present invention.

FIG. 5 is a block diagram of an internal-combustion-engine electronic control system according to Embodiment 2 of the present invention. In FIG. 5, a third slow-discharge circuit 21 is configured in such a way as to be capable of selecting the discharge time constant of the capacitor 17, based on the output signals from CPU 11, the timer circuit 12, and the overheating detection circuit 13. A fourth slow-discharge circuit 22 is configured in such a way as to be capable of adjusting the discharge time constant of the capacitor 17, based on the output signal from the current detection circuit 14. The other configurations are the same as those in Embodiment 1 described above.

When any one of CPU 11, the timer circuit 12, and the overheating detection circuit 13 detects an abnormality, the level of the output signal thereof changes from a LOW level to a HIGH level, and the output signal is inputted to the base of the PNP-type transistor 101 and the third slow-discharge circuit 21. When the current detection circuit 14 detects an abnormality, the level of the output signal thereof changes from a LOW level to a HIGH level, and the output signal is inputted to the base of the PNP-type transistor 101 and the fourth slow-discharge circuit 22.

Therefore, in the case where any one of CPU 11, the timer circuit 12, the overheating detection circuit 13, and the current detection circuit 14 outputs a HIGH-level output signal to be inputted to the base of the PNP-type transistor 101, the PNP-type transistor 101 turns off, so that the primary current of the ignition coil 2 is softly shut off, as described later.

Figure 6:
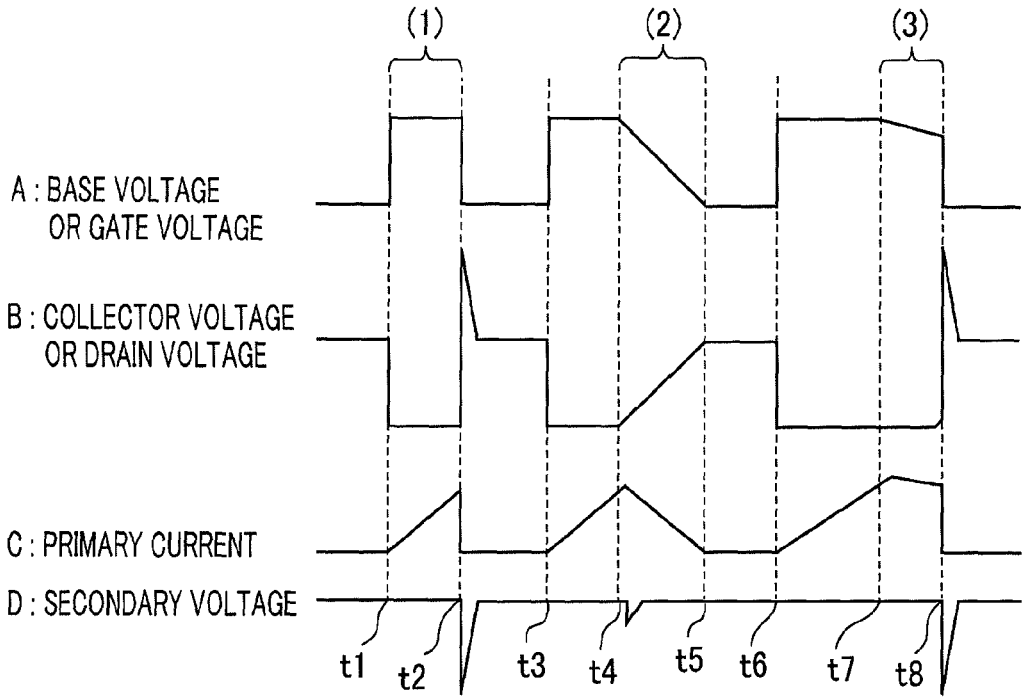
FIG. 6 is a timing chart for explaining the operation of an internal-combustion-engine electronic control system according to Embodiment 2 of the present invention.

FIG. 6 is a timing chart for explaining the operation of the internal-combustion-engine electronic control system according to Embodiment 2 of the present invention. FIG. 6(A) represents the waveform of the base voltage or the gate voltage of the power switching device 103; FIG. 6(B) represents the waveform of the collector voltage or the drain voltage of the power switching device 103; FIG. 6(C) represents the waveform of the primary current flowing in the primary winding of the ignition coil 2; FIG. 6(D) represents the waveform of the secondary voltage induced across the secondary winding of the ignition coil 2.

In FIG. 6, in the duration (1) from a time point t1 to a time point t2, based on the ignition signal outputted from CPU 11, a base voltage A or a gate voltage A of a predetermined HIGH level is applied to the base or the gate of the power switching device 103. As a result, the power switching device 103 turns on; the collector voltage B or the drain voltage B thereof becomes an electric potential of a predetermined LOW level, whereby the primary current flowing in the primary winding of the ignition coil 2 gradually increases. In this situation, no voltage is induced across the ignition coil 2.

At the time point t2 when the duration (1) terminates, the base voltage A or the gate voltage A of the power switching device 103 is shut out, thereby changing to the LOW level. As a result, the power switching device 103 turns off; the collector voltage B or the drain voltage B thereof instantaneously changes from the LOW level to a high voltage because the primary current C of the ignition coil 2 is shut off, and then becomes a predetermined HIGH level. Because the primary current C of the ignition coil 2 is shut off at the time point t2, a secondary voltage D, which is a high voltage, is induced across the secondary winding of the ignition coil 2. An ignition plug 3 produces a spark discharge by use of the secondary voltage D, which is a high voltage induced across the secondary winding of the ignition coil 2 so as to ignite a fuel in an unillustrated combustion chamber of an internal combustion engine.

Next, at a time point t3, based on the ignition signal outputted from CPU 11, the base voltage A or the gate voltage A of the predetermined HIGH level is applied again to the base or the gate of the power switching device 103. As a result, the power switching device 103 turns on; the collector voltage B or the drain voltage B thereof becomes an electric potential of a predetermined LOW level, whereby the primary current flowing in the primary winding of the ignition coil 2 gradually increases. In this situation, no voltage is induced across the ignition coil 2.

In this case, for example, when at a time point t4, the duration where the ignition signal from CPU 11 is HIGH-level exceeds a predetermined time, the level of the output signal of the timer circuit 12 changes from the LOW level to the HIGH level, and the HIGH-level output signal is inputted to the base of the PNP-type transistor and the third slow-discharge circuit 21. Alternatively, when at the time point t4, the overheating detection circuit 13 detects the fact that an electronic component included in the ignition device has overheated, a HIGH-level output signal from the overheating detection circuit 13 is applied to the base of the PNP-type transistor 101 and the third slow-discharge circuit 21. Because the HIGH-level signal is inputted to the base of the PNP-type transistor, the state of the PNP-type transistor 101 changes from "ON" to "OFF".

When the PNP-type transistor 101 turns off at the time point t4, the electric charge stored in the capacitor 17 is slowly discharged by way of the third slow-discharge circuit 21. The duration of this slow discharge is represented as the duration (2) in FIG. 6. Even after the power switching device 103 has moved to the active region, the base voltage A or the gate voltage A continues to lower; in contrast, the collector voltage B or the drain voltage B of the power switching device 103 rises. By setting the discharge time constant of the third slow-discharge circuit 21 in such a way that the value of the secondary voltage D of the ignition coil 2 becomes a value that is as small as possible and with which the ignition plug does not produce any spark discharge, it is made possible that the power switching device 103 is softly shut off in a relatively short time from the time point t4 to a time point t5 and hence the ignition plug 3 does not produce any spark discharge.

Next, at a time point t6, based on the ignition signal outputted from CPU 11, the base voltage A or the gate voltage A of the predetermined HIGH level is applied again to the base or the gate of the power switching device 103. As a result, the power switching device 103 turns on; the collector voltage B or the drain voltage B thereof becomes an electric potential of a predetermined LOW level, whereby the primary current flowing in the primary winding of the ignition coil 2 gradually increases. In this situation, no voltage is induced across the ignition coil 2.

Next, when at a time point t7, the current detection circuit 14 detects the fact that a current flowing in the power switching device 103 is excessive current, a HIGH-level output signal from the current detection circuit 14 is inputted to the base of the PNP-type transistor 101 and the fourth slow-discharge circuit 22. Because the HIGH-level signal is inputted to the base of the PNP-type transistor, the state of the PNP-type transistor 101 changes from "ON" to "OFF".

When the PNP-type transistor 101 turns off at the time point t7, the electric charge stored in the capacitor 17 is slowly discharged by way of the fourth slow-discharge circuit 22, as represented in the duration (3) in FIG. 6. By setting the discharge time constant of the fourth slow-discharge circuit 22 in such a way as to be as large as possible, it is made possible that even in the case where a fluctuation in the engine rotation speed prolongs the energization duration, the power switching device 103 is instantaneously turned off at a regular ignition timing t8 when CPU 11 issues a command so that the primary current of the ignition coil 2 is shut off, a high-voltage secondary voltage is induced across the secondary winding of the ignition coil 2, and then the ignition plug 3 produces a spark discharge.

The foregoing operation in the duration (3), which is performed because the current detection circuit 14 detects an excessive current, is similar to the operation in the case where a current limiting circuit is added; in the internal-combustion-engine electronic control system according to Embodiment 2 of the present invention, addition of a simple circuit makes it possible to obtain an effect the same as that obtained in the case where a current limiting circuit is provided.

The internal-combustion-engine electronic control system according to Embodiment 2 of the present invention, described heretofore, is provided with characteristics set forth below:

(1) The internal-combustion-engine electronic control system is provided with a power switching device that applies or shuts off a primary current of an ignition coil of an internal combustion engine so that at the secondary side of the ignition coil, there is generated a voltage for making an ignition plug of the internal combustion engine produce a spark discharge; and a control unit that turns on or off the power switching device. The internal-combustion-engine electronic control system is characterized in that the control unit is provided with a circuit unit that makes the power switching device softly shut off so as to prevent the ignition plug from producing the spark discharge, in the case where at least one of the power switching device, the control unit, the ignition coil, and the ignition plug is in a predetermined state; in that the circuit unit includes a capacitor, a first slow-discharge circuit that makes electric charge in the capacitor discharge with a predetermined time constant, and a second slow-discharge circuit that makes electric charge in the capacitor discharge with a time constant that is smaller than the time constant of the first slow-discharge circuit 15; and in that based on the predetermined state, the control unit selects one of the first slow-discharge circuit and the second slow-discharge circuit and makes the capacitor discharge electric charge so as to perform the soft shutoff.

(2) In the control unit, the circuit unit is provided with a function of suppressing a secondary voltage from making the ignition plug produce a spark discharge when energization of the ignition coil with the primary current is started.

(3) The control unit is provided with a current detection circuit that detects the primary current flowing in the ignition coil, and when the current detection circuit detects the fact that the primary current is the same as or larger than a predetermined value, the control unit selects one of the first slow-discharge circuit and the second slow-discharge circuit so as to perform the soft shutoff.

(4) The control unit is provided with an overheating detection circuit that detects overheating in at least one of the constituent elements included in the control unit, and when the overheating detection circuit detects the overheating, the control unit selects one of the first slow-discharge circuit and the second slow-discharge circuit so as to perform the soft shutoff.

(5) The control unit is provided with a timer circuit that detects a continuous energization duration of the primary current flowing in the ignition coil, and when the timer circuit detects the fact that the continuous energization duration is the same as or longer than a predetermined value, the control unit selects one of the first slow-discharge circuit and the second slow-discharge circuit so as to perform the soft shutoff.

Embodiment 3

Next, there will be explained an internal-combustion-engine electronic control system according to Embodiment 3 of the present invention. In Embodiment 3, by combining a slow-discharge circuit with a current limiting circuit, for limiting the primary current flowing in the ignition coil, that is a circuit for suppressing the secondary voltage from making the ignition plug produce a spark discharge when energization of the ignition coil is started, the signal outputted from the power switching device is suppressed from oscillating when the primary current is limited.

Figure 7:
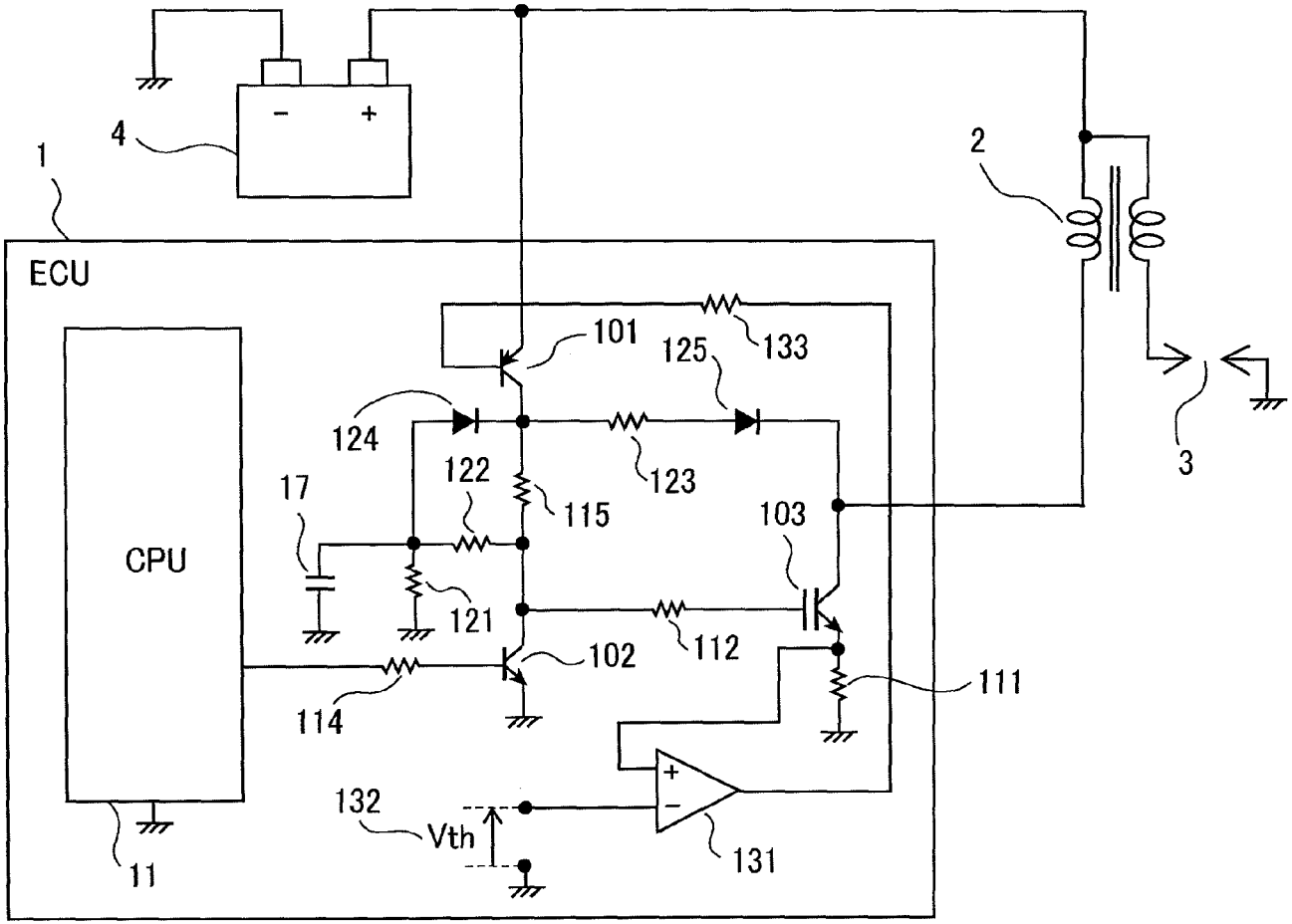
FIG. 7 is a block diagram of an internal-combustion-engine electronic control system according to Embodiment 3 of the present invention.

FIG. 7 is a block diagram of an internal-combustion-engine electronic control system according to Embodiment 3 of the present invention.

The current detection resistor 111 connected with the emitter or the source of the power switching device 103 converts the primary current of the ignition coil 2 into a voltage; when this voltage exceeds a reference voltage (Vth) 132 of an operational amplifier 131, the level of the output of the operational amplifier 131 changes from a LOW level to a HIGH level, and the output is inputted to the base of the PNP-type transistor 101 by way of a resistor 133.

When receiving a HIGH-level signal from the operational amplifier 131, the state of the PNP-type transistor 101 changes from "ON" to "OFF". When the PNP-type transistor 101 turns off, the charge stored in the capacitor 17 is slowly discharged through the resistor 121 included in the first slow-discharge circuit that is configured in the same manner as the first slow-discharge circuit in Embodiment 1, the resistors 115, 122, and 123 that configure the second slow-discharge circuit, and the diodes 124 and 125.

As a result, as is the case with Embodiment 1, because the base voltage of the gate voltage of the power switching device 103 slowly lowers, the primary current of the ignition coil also decreased slowly. When the primary current of the ignition coil slowly decreases and then the voltage generated across the resistor 111 becomes lower than the reference voltage 132, the level of the output of the operational amplifier 131 changes from the HIGH level to the LOW level; then, the LOW-level signal is inputted to the base of the transistor 101 by way of the resistor 133. Accordingly, the state of the PNP-type transistor 101 changes from "OFF" to "ON", whereby the power switching device 103 turns on.

When the power switching device 103 turns on and hence energization of the primary winding of the ignition coil 2 is started, the base voltage or the gate voltage of the power switching device 103 slowly rises due to the circuit for suppressing the secondary voltage of the ignition coil 2 from making the ignition plug produce a spark discharge; therefore, the primary current of the ignition coil 2 also rises slowly. While the current is limited, the foregoing operation is repeated so that the amount of the primary current of the ignition coil 2 is slowly controlled; thus, there is demonstrated an effect that a signal outputted from the power switching device 103 is suppressed from oscillating.

In Embodiment 3 illustrated in FIG. 7, the timer circuit and the overheating detection circuit 13 provided in Embodiment 1 are not provided; however, it goes without saying that the timer circuit 12 and the overheating detection circuit 13 similar to those in Embodiment 1 may be provided.

The internal-combustion-engine electronic control system according to Embodiment 3 of the present invention, described heretofore, is provided with characteristics set forth below:

(1) The internal-combustion-engine electronic control system is provided with a power switching device that applies or shuts off a primary current of an ignition coil of an internal combustion engine so that at the secondary side of the ignition coil, there is generated a voltage for making an ignition plug of the internal combustion engine produce a spark discharge; and a control unit that turns on or off the power switching device. The control unit is provided with a circuit unit that makes the power switching device softly shut off so as to prevent the ignition plug from producing the spark discharge, in the case where at least one of the power switching device and the control unit is in a predetermined state; and based on a change in the conduction state of the power switching device, the characteristics of the soft shutoff is changed halfway through the shutoff operation.

(2) The circuit unit includes a capacitor, a first slow-discharge circuit that makes electric charge in the capacitor discharge with a predetermined time constant, and a second slow-discharge circuit that makes electric charge in the capacitor discharge with a time constant that is smaller than the time constant of the first slow-discharge circuit; and when the soft shutoff is started, the control unit makes electric charge in the capacitor discharge by use of the second slow-discharge circuit so as to make the power switching device perform soft shutoff operation, and then makes electric charge in the capacitor discharge by use of the first slow-discharge circuit so as to make the power switching device perform soft shutoff operation.

(3) In the control unit, the circuit unit is provided with a function of suppressing a secondary voltage from making the ignition plug produce a spark discharge when energization of the ignition coil with the primary current is started.

(4) The internal-combustion-engine electronic control system control unit is provided with a current limiting circuit that limits the primary current flowing in the ignition coil.

(5) The control unit is provided with a current detection circuit that detects the primary current flowing in the ignition coil, and when the current detection circuit detects the fact that the primary current is the same as or larger than a predetermined value, the control unit selects one of the first slow-discharge circuit and the second slow-discharge circuit so as to perform the soft shutoff.

(6) The control unit is provided with an overheating detection circuit that detects overheating in at least one of the constituent elements included in the control unit, and when the overheating detection circuit detects the overheating, the control unit selects one of the first slow-discharge circuit and the second slow-discharge circuit so as to perform the soft shutoff.

(7) The control unit is provided with a timer circuit that detects a continuous energization duration of the primary current flowing in the ignition coil, and when the timer circuit detects the fact that the continuous energization duration is the same as or longer than a predetermined value, the control unit selects one of the first slow-discharge circuit and the second slow-discharge circuit so as to perform the soft shutoff.

In addition, in each of Embodiments 1 through 3, the slow-discharge circuit is formed of a time constant circuit consisting of a capacitor and a resistor; however, there is obtained the same effect by controlling the base voltage or the gate voltage of the power switching device by use of a constant current circuit or the like.

Moreover, in each of Embodiments 1 through 3, there are provided both the first slow-discharge circuit and the second slow-discharge circuit; however, even if two or more slow-discharge circuits are utilized, the same effect can be demonstrated.

Still moreover, it goes without saying that with regard to the present invention, by combining and utilizing the circuits of the foregoing embodiments, the respective effects thereof can be demonstrated.

Various modifications and alterations of this invention will be apparent to those skilled in the art without departing from the scope and spirit of this invention, and it should be understood that this is not limited to the illustrative embodiments set forth herein.

What is claimed is:

1. An internal-combustion-engine electronic control system comprising:

a power switching device that applies or shuts off a primary current of an ignition coil of an internal combustion engine so that at the secondary side of the ignition coil, there is generated a voltage for making an ignition plug of the internal combustion engine produce a spark discharge; and a control unit that turns on or off the power switching device, wherein the control unit is provided with a circuit unit that softly shuts off the power switching device so as to prevent the ignition plug from producing the spark discharge, in the case where at least one of the power switching device, the control unit, the ignition coil, and the ignition plug is in a predetermined state; and based on a change in the conduction state of the power switching device, the characteristics of the soft shutoff is changed halfway through the shutoff operation, wherein the circuit unit includes a capacitor, a first slow-discharge circuit that makes electric charge in the capacitor discharge with a first predetermined time constant, and a second slow-discharge circuit that makes electric charge in the capacitor discharge with a second predetermined time constant that is smaller than the first predetermined time constant, wherein when the soft shutoff is started, the control unit causes electric charge in the capacitor to discharge by use of the second slow-discharge circuit so as to make the power switching device begin a soft shutoff operation, and then causes electric charge in the capacitor to discharge by use of the first slow-discharge circuit, until completion of the soft shutoff operation, and wherein in the control unit, the circuit unit is provided with a function of suppressing a secondary voltage from making the ignition plug produce a spark discharge when energization of the ignition coil with the primary current is started.

2. The internal-combustion-engine electronic control system according to claim 1, wherein the control unit is provided with a current limiting circuit that limits the primary current flowing in the ignition coil.

3. An internal-combustion-engine electronic control system comprising:

a power switching device that applies or shuts off a primary current of an ignition coil of an internal combustion engine so that at the secondary side of the ignition coil, there is generated a voltage for making an ignition plug of the internal combustion engine produce a spark discharge; and a control unit that turns on or off the power switching device, wherein the control unit is provided with a circuit unit that makes the power switching device softly shut off so as to prevent the ignition plug from producing the spark discharge, in the case where at least one of the power switching device, the control unit, the ignition coil, and the ignition plug is in a predetermined state, wherein the circuit unit includes a capacitor, a first slow-discharge circuit that makes electric charge in the capacitor discharge with a predetermined time constant, and a second slow-discharge circuit that makes electric charge in the capacitor discharge with a time constant that is smaller than the time constant of the first slow-discharge circuit, and wherein based on the predetermined state, the control unit selects one of the first slow-discharge circuit and the second slow-discharge circuit and makes the capacitor discharge electric charge so as to perform the soft shutoff, and wherein in the control unit, the circuit unit is provided with a function of suppressing a secondary voltage from making the ignition plug produce a spark discharge when energization of the ignition coil with the primary current is started.

4. The internal-combustion-engine electronic control system according to claim 3, wherein the control unit is provided with a current limiting circuit that limits the primary current flowing in the ignition coil.

5. The internal-combustion-engine electronic control system according to claim 3, wherein the control unit is provided with a current detection circuit that detects the primary current flowing in the ignition coil, and when the current detection circuit detects the fact that the primary current is the same as or larger than a predetermined value, the control unit selects one of the first slow-discharge circuit and the second slow-discharge circuit so as to perform the soft shutoff.

6. The internal-combustion-engine electronic control system according to claim 3, wherein the control unit is provided with an overheating detection circuit that detects overheating in at least one of the constituent elements included in the control unit, and when the overheating detection circuit detects the overheating, the control unit selects one of the first slow-discharge circuit and the second slow-discharge circuit so as to perform the soft shutoff.

7. The internal-combustion-engine electronic control system according to claim 3, wherein the control unit is provided with a timer circuit that detects a continuous energization duration of the primary current flowing in the ignition coil, and when the timer circuit detects the fact that the continuous energization duration is the same as or longer than a predetermined value, the control unit selects one of the first slow-discharge circuit and the second slow-discharge circuit so as to perform the soft shutoff.

8. An internal-combustion-engine electronic control system comprising:

a power switching device that applies or shuts off a primary current of an ignition coil of an internal combustion engine so that at the secondary side of the ignition coil, there is generated a voltage for making an ignition plug of the internal combustion engine produce a spark discharge; and a control unit that turns on or off the power switching device, wherein the control unit is provided with a circuit unit that softly shuts off the power switching device so as to prevent the ignition plug from producing the spark discharge, in the case where at least one of the power switching device, the control unit, the ignition coil, and the ignition plug is in a predetermined state, wherein the circuit unit includes a capacitor, a first slow-discharge circuit that makes electric charge in the capacitor discharge with a predetermined time constant, and a second slow-discharge circuit that makes electric charge in the capacitor discharge with a time constant that is smaller than the time constant of the first slow-discharge circuit, wherein the control unit is provided with an overheating detection circuit that detects overheating in at least one of the constituent elements included in the control unit, and when the overheating detection circuit detects the overheating, the control unit selects one of the first slow-discharge circuit and the second slow-discharge circuit so as to perform the soft shutoff, and wherein in the control unit, the circuit unit is provided with a function of suppressing a secondary voltage from making the ignition plug produce a spark discharge when energization of the ignition coil with the primary current is started.

9. The internal-combustion-engine electronic control system according to claim 8, wherein the control unit is provided with a current detection circuit that detects the primary current flowing in the ignition coil, and when the current detection circuit detects the fact that the primary current is the same as or larger than a predetermined value, the control unit selects one of the first slow-discharge circuit and the second slow-discharge circuit so as to perform the soft shutoff.

10. The internal-combustion-engine electronic control system according to claim 8, wherein the control unit is provided with a timer circuit that detects a continuous energization duration of the primary current flowing in the ignition coil, and when the timer circuit detects the fact that the continuous energization duration is the same as or longer than a predetermined value, the control unit selects one of the first slow-discharge circuit and the second slow-discharge circuit so as to perform the soft shutoff.

11. The internal-combustion-engine electronic control system according to claim 9, wherein the time constant of the selected slow-discharge is set such that if a fluctuation in engine rotation speed prolongs an energization duration of the primary current in the ignition coil, the power switching device shuts off the primary current of the ignition coil at a regular ignition timing so that at the secondary side of the ignition coil, there is generated a voltage for making an ignition plug of the internal combustion engine produce a spark discharge.

12. An internal-combustion-engine electronic control system comprising:

a power switching device that applies or shuts off a primary current of an ignition coil of an internal combustion engine so that at the secondary side of the ignition coil, there is generated a voltage for making an ignition plug of the internal combustion engine produce a spark discharge; and a control unit that turns on or off the power switching device, wherein the control unit is provided with a circuit unit that softly shuts off the power switching device so as to prevent the ignition plug from producing the spark discharge, in the case where at least one of the power switching device, the control unit, the ignition coil, and the ignition plug is in a predetermined state; and based on a change in the conduction state of the power switching device, the characteristics of the soft shutoff is changed halfway through the shutoff operation, wherein the circuit unit includes a capacitor, a first slow-discharge circuit including a first resistor that makes electric charge in the capacitor discharge with a first predetermined time constant, and a second slow-discharge circuit including a second resistor that makes electric charge in the capacitor discharge with a second predetermined time constant that is smaller than the first predetermined time constant, wherein when the soft shutoff is started, the control unit causes electric charge in the capacitor to discharge by use of the second slow-discharge circuit so as to make the power switching device begin a soft shutoff operation, and then causes electric charge in the capacitor to discharge by use of the first slow-discharge circuit, until completion of the soft shutoff operation, and wherein in the control unit, the circuit unit is provided with a function of suppressing a secondary voltage from making the ignition plug produce a spark discharge when energization of the ignition coil with the primary current is started.

* * * * *